US006707361B2

(12) United States Patent
Blume

(10) Patent No.: US 6,707,361 B2
(45) Date of Patent: Mar. 16, 2004

(54) BONDED PERMANENT MAGNETS

(75) Inventor: Walter Scott Blume, Cincinnati, OH (US)

(73) Assignee: The Electrodyne Company, Inc., Batavia, OH (US)

( * ) Notice: Subject to any disclaimer, the term of this patent is extended or adjusted under 35 U.S.C. 154(b) by 123 days.

(21) Appl. No.: 10/118,833

(22) Filed: Apr. 9, 2002

(65) Prior Publication Data

US 2003/0189475 A1 Oct. 9, 2003

(51) Int. Cl.[7] ..... H01F 41/02

(52) U.S. Cl. ..... 335/296; 252/62.54; 252/62.55; 335/302; 335/303

(58) Field of Search ..... 252/62.54–62.55; 335/296–303

(56) References Cited

U.S. PATENT DOCUMENTS

| | | | | |
|---|---|---|---|---|
| 3,235,675 | A | 2/1966 | Blume | |
| 3,428,603 | A | 2/1969 | Kroenke | 252/62.54 |
| 4,200,547 | A | 4/1980 | Beck | 252/62.54 |
| 4,689,163 | A | 8/1987 | Yamashita et al. | 252/62.54 |
| 4,808,224 | A | 2/1989 | Anderson et al. | 75/246 |
| 4,873,504 | A | 10/1989 | Blume, Jr. et al. | 335/303 |
| 5,002,677 | A | 3/1991 | Srail et al. | 252/62.54 |
| 5,051,200 | A | 9/1991 | Srail et al. | 252/62.54 |
| 5,164,104 | A | 11/1992 | Kobayashi et al. | 252/62.57 |
| 5,176,842 | A | 1/1993 | Kuwazawa et al. | 252/62.54 |
| 5,190,684 | A | 3/1993 | Yamashita et al. | 252/62.54 |
| 5,240,513 | A | 8/1993 | McCallum et al. | 148/104 |
| 5,424,703 | A | 6/1995 | Blume, Jr. | 335/254 |
| 5,470,401 | A | 11/1995 | McCallum et al. | 148/302 |
| 5,567,757 | A | 10/1996 | Szczepanski | 524/435 |
| 5,648,013 | A | 7/1997 | Uchida et al. | 252/62.54 |
| 6,001,272 | A | 12/1999 | Ikuma et al. | 242/62.54 |
| 6,007,757 | A | 12/1999 | Honkura et al. | 264/429 |
| 6,019,859 | A | 2/2000 | Kanekiyo et al. | 148/302 |
| 6,312,795 | B1 | 11/2001 | Yamamoto | 428/323 |

FOREIGN PATENT DOCUMENTS

| | | | |
|---|---|---|---|
| JP | 02079404 | 3/1990 | C06K/3/06 |
| JP | 08111306 | 4/1996 | H01F/1/06 |

*Primary Examiner*—Ramon M. Barrera
(74) *Attorney, Agent, or Firm*—Wood, Herron & Evans, LLP

(57) ABSTRACT

A flexible permanent magnet containing atomized, generally spherical rare earth magnet particles bonded in a binder resin including a nitrile rubber and precipitated amorphous silica. The bonded permanent magnet exhibits high mechanical flexibility and elasticity, good magnetic properties, and good heat aging, and the magnet powder may be mixed with the binder resin with little to no risk of combustion. In an exemplary embodiment, a permanent magnet composition includes a nitrile rubber with about 23–37% acrylonitrile content, an ethylene vinyl acetate copolymer, a precipitated amorphous silica, and atomized, generally spherical rare earth magnet particles having a size distribution including a median particle size in the range of about 35–55 $\mu$m with a standard deviation in the range of about 10–30 $\mu$m and less than about 0.1% of the particles having a diameter above about 115 $\mu$m. Bonded permanent magnets of the present invention exhibit a percent ultimate elongation greater than about 100%, and even greater than about 200%, thereby providing at least a 10-fold improvement in elasticity concurrently with good magnetic properties.

51 Claims, 1 Drawing Sheet

BONDED PERMANENT MAGNETS

FIELD OF THE INVENTION

This invention relates to composite bonded permanent magnets having high flexibility and high magnetic particle loading.

BACKGROUND OF THE INVENTION

Bonded magnets are manufactured from mixtures of magnetic powders and binding resins by pressure-molding the mixtures into desired magnet shapes. Of particular interest are the rare earth bonded magnets comprising a magnet powder containing a rare earth element or elements, which rare earth elements are generally understood to include elements 21, 39 and 57–71 of the periodic table of the elements. An exemplary rare earth magnet alloy is neodymium-iron-boron (Nd—Fe—B).

The methods of manufacturing rare earth bonded magnets generally include mixing magnet material with a binder resin and forming the mixture into sheets, strips, or net shape parts by compaction molding, roll molding, injection molding and extrusion molding the mixture. In each of these processes, it is desirable to maximize the particle loading of the magnet material to provide optimum magnetic properties for the permanent magnet. In addition, it is desirable to provide a permanent magnet that is flexible. It has, however, been difficult to achieve a bonded magnet having both high magnetic properties and high mechanical flexibility.

In the various permanent magnet manufacturing methods, rapidly solidified, melt-spun ribbons of the magnetic material are comminuted into irregularly sized and shaped particles, specifically irregular flakes, which are then combined with the binder resin. Mixing methods may include calendar rolling or Banbury intensive mixing, for example. It is difficult to obtain high loading volume with very small flakes because it becomes increasingly difficult for the given volume of binder to wet the surface of the flakes as the particle size diminishes due to the intensive mixing process, so as to form a homogeneous and cohesive mixture. It has been observed that, after a certain loading is reached, the mixture tends increasingly to reject further particles, and the mixture becomes dry, crumbly, and loses adherence to further particles. Thus, larger, coarse flakes are used, but the large flakes interlock to an extent that harms homogeneity and mechanical flexibility. These large flakes also have a high tendency to fracture due to their brittle nature, such that the particle surface area increases. The binder matrix is weakened, and the composition then becomes dry and crumbly because the same amount of binder is present for coating an increased surface area.

In addition, with rare earth magnet material, the flakes easily oxidize if their size is reduced below a threshold value, causing the flakes to become pyrophoric and prone to spontaneous combustion if exposed to air even briefly. Due to the pyrophoric nature of the material, it has thus been considered necessary to incorporate large particles into the binder matrix. As previously stated, however, these large flakes have a tendency to fracture during the mixing and molding process, creating new surface area for oxidation and thereby creating the possibility for spontaneous combustion throughout the mixing and molding process. Also, upon fracture, binder is displaced, causing interference between flakes, and thus sparking within the mixture. Consequently, precautions must be taken due to the risk of sparking and fire, such as mixing of the flake particulate with the binder in an inert atmosphere. The need for precautions is particularly necessary in a batch process using a Banbury intensive mixer. Morever, as the flakes fracture, the magnetic properties drop dramatically.

In addition to the risk of fire and sparking due to fracturing of the flakes, coarse particles also tend to react adversely with and degrade in a wide range of polymer binder materials. Spontaneous pyrophoric and/or exothermic reactions with coarse NdFeB particles have occurred with various elastomers. While some reactions occur very suddenly, other mixtures slowly decompose, thereby compromising the long term stability of the rare earth bonded magnets. Some magnets have been limited to room temperature use due to poor heat aging.

Thus, there has been a need for a rare earth type permanent magnet having a high particle loading for optimum magnetic properties and high mechanical flexibility that is not highly pyrophoric during manufacture and which has long term high temperature stability, i.e., good heat aging.

SUMMARY OF THE INVENTION

The present invention provides a flexible permanent magnet in which atomized, generally spherical rare earth magnetic particles are bonded in a binder system including a nitrile rubber and precipitated amorphous silica. The bonded permanent magnets exhibit high mechanical flexibility and elasticity, good magnetic properties, and good heat aging. In addition, the magnet powder may be mixed with the binder with little to no risk of combustion. In an exemplary embodiment, a permanent magnet is provided comprising a nitrile rubber with about 23–37% acrylonitrile content, an ethylene vinyl acetate copolymer, a precipitated amorphous silica, and atomized, generally spherical rare earth magnet particles having a size distribution including a median particle size in the range of about 35–55 $\mu$m with a standard deviation in the range of about 10–30 $\mu$m and less than about 0.1% of the particles having a diameter above about 115 $\mu$m, wherein the magnet has a percent ultimate elongation greater than about 100%.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

The present invention provides bonded permanent magnets of the rare earth type that exhibit high mechanical flexibility and elasticity, good magnetic properties, and good heat aging, which magnets may be produced with little to no risk of combustion. To this end, atomized, generally spherical rare earth magnet particles are mixed in a binder that includes a nitrile rubber and a precipitated amorphous silica. The composition advantageously comprises the rare earth magnet particles at a volumetric loading of about 30 vol. % to about 80 vol. %, and advantageously at a loading of about 58 vol. % to about 74 vol. %. The binder, which includes the nitrile rubber and silica, therefore comprises about 20–70 vol. % and advantageously about 26–42 vol. % of the composition. In an exemplary embodiment of the present invention, the binder may further comprise a thermoplastic resin, such as an ethylene vinyl acetate copolymer.

Figure 1:
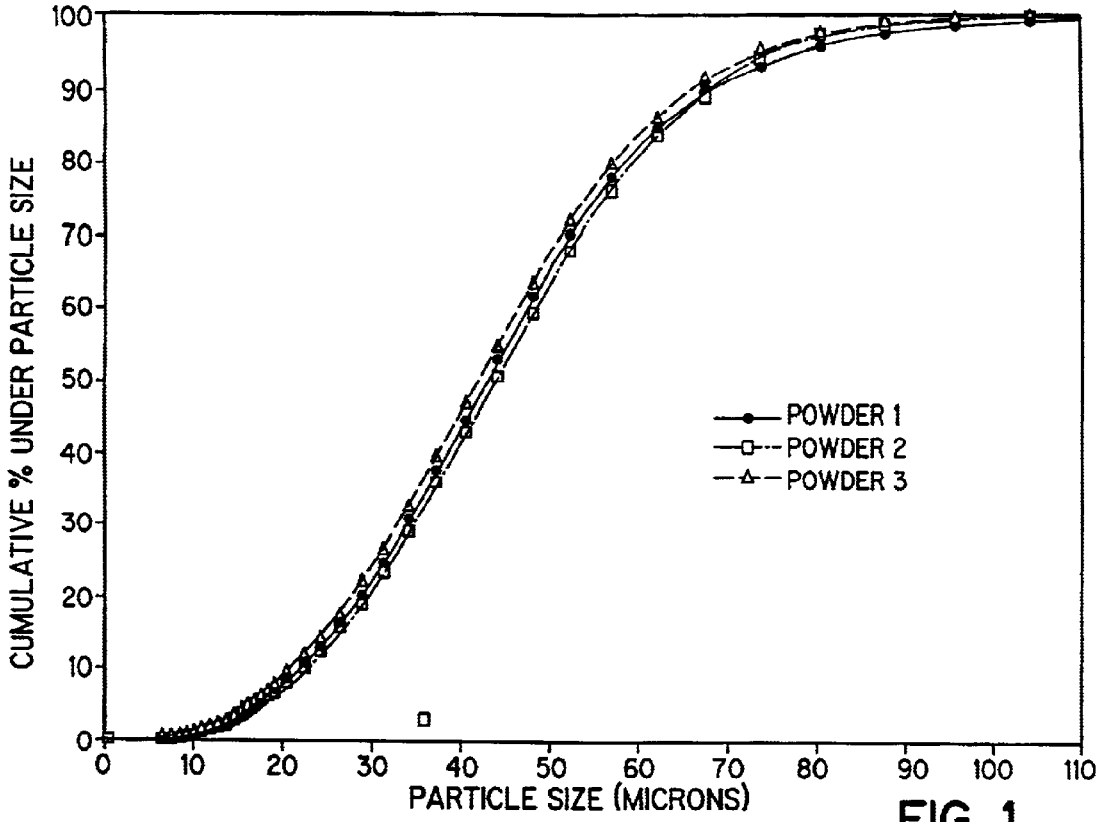
FIG. 1 is particle size distribution plot depicting the cumulative percent of particles under a given particle size for an exemplary magnet powder for use in the composition of the present invention.

The rare earth magnet particles in the composition of the present invention are generally spherical and are produced by an atomization process, which is a generally known technique for producing various powders. Due to the regular, spherical shape, the particles are coated with binder more effectively than the irregular crushed ribbon particles. Moreover, the spheres do not have a tendency to fracture. Advantageously, the particle size distribution is such that about 10% or less of the particles have a diameter less than about 20 $\mu$m and less than about 10% have a diameter greater than about 70 $\mu$m. Further, less than about 0.1 wt. % of the particles have a diameter above about 115 $\mu$m. Advantageously, the median diameter is in the range of about 35–55 $\mu$m with a standard deviation or distribution width of about 10–30 $\mu$m. An exemplary neodymium-iron-boron magnet powder for use in the present invention is supplied by Magnequench International, Inc. of Anderson, Ind., under product number MQP®-S-9-8. FIG. 1 is a particle size distribution plot for three blends of MQP®-S-9-8 powder, as supplied by Magnequench. The powder is described as an atomized, annealed spherical powder and is made by a proprietary atomization process. Advantageously, the median particle size is in the range of about 40–45 $\mu$m.

The rare earth magnet particles of the present invention include those magnetic or magnetizable materials that contain at least one rare earth element therein, that is an element having an atomic number of 21, 39 or 57–71, namely Sc, Y, La, Ce, Pr, Nd, Pm, Sm, Eu, Gd, Tb, Dy, Ho, Er, Tm, Yb and Lu. Such elements may be contained in either minor or major amounts. The rare earth magnet material may include minor or major amounts of non-rare earth elements, such as iron, cobalt, nickel, boron and the like. The rare earth magnet particles are advantageously an alloy of a rare earth element and a transition metal. Rare earth-iron-boron alloys, especially Nd—Fe—B alloys, are preferred in practicing the invention as a result of their demonstrated excellent magnetic properties. Alternatively, the rare earth magnet particles may comprise an alloy such as Pr—Fe—B, Sm—Co, Sm—Fe—Co, Sm—Fe—N or Dy—Co.

The content of the magnet powder in the composition may range from about 30 to about 80 vol. % and advantageously the volumetric loading is between about 58 and about 74 vol. %. Most advantageously, the rare earth magnet particles are present in an amount of about 73–74 vol. %. If the magnet powder content is too small, the permanent magnet does not exhibit the desired magnetic characteristics, and conversely, if the magnet powder content is too large, the permanent magnet does not exhibit the desired physical properties and may experience increased magnetic leakage and susceptibility to fracture without any beneficial increase in magnetic performance. Thus, below about 30 vol. %, the composition is not practical for use in a bonded permanent magnet. From a practical standpoint, a volumetric loading of at least about 58% is desirable for the magnet to exhibit the minimum desirable magnetic properties. Though a loading greater than about 80 vol. % could be achieved, the physical properties become undesirable, and little to no benefit in magnetic performance is achieved. From a practical standpoint, optimal magnetic and physical properties are achieved at a volumetric loading of about 73–74%. However, it may be appreciated that different uses have different requirements, for example, bio-magnetic applications may place more emphasis on physical properties with lower magnetic properties being acceptable as compared to that required, for example, in a motor. Therefore, the invention should not be limited with respect to the content of magnetic particles.

Figure 2:
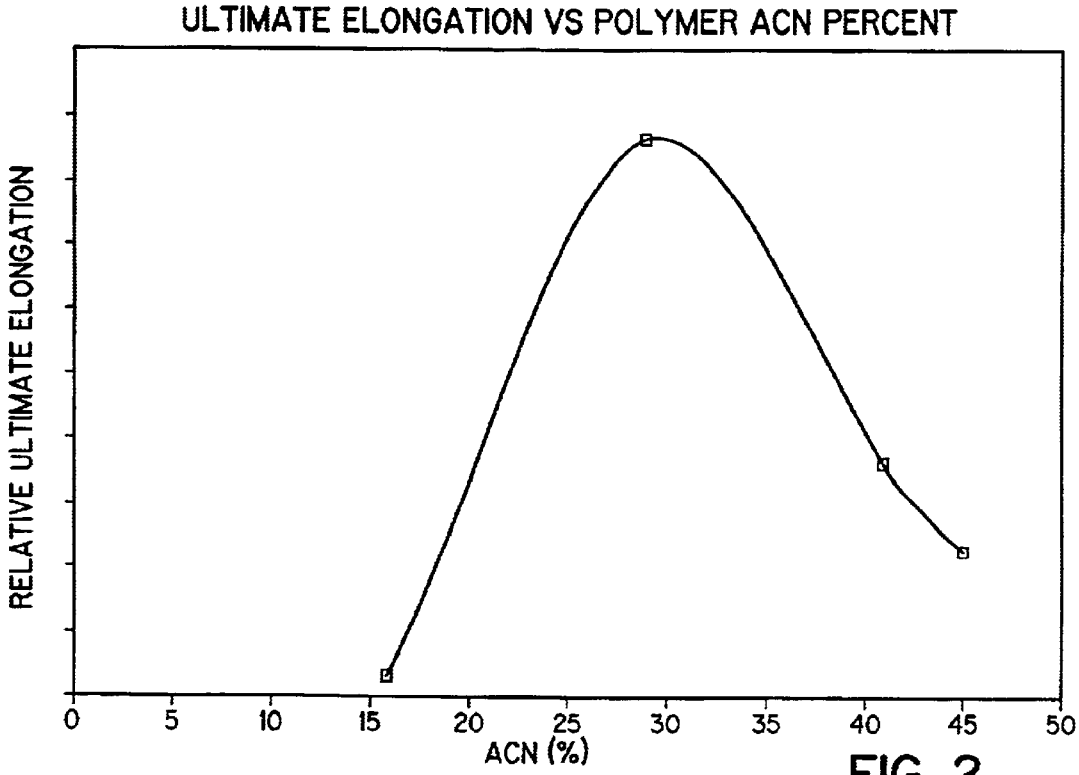
FIG. 2 is a plot of the ultimate percent elongation of a bonded magnet of the present invention as a function of acrylonitrile content in the binder.

The atomized spherical rare earth magnet particles are mixed in a binder. The binder system includes a nitrile rubber and a precipitated amorphous silica. The nitrile rubber of the binder contributes to a permanent magnet having the desired mechanical flexibility. In addition, an unexpected and substantial increase in ultimate elongation, i.e., elasticity, is exhibited with the permanent magnets of the present invention. The nitrile rubbers are generally copolymers of acrylonitrile or esters thereof with a conjugated diene monomer, such as butadiene, isoprene, hexadiene and the like. A copolymer of butadiene and acrylonitrile is an exemplary nitrile rubber for use in the binder system of the present invention. The average acrylonitrile content in the nitrile rubber is advantageously in the range of about 16–51%, more advantageously about 23–37%, and most advantageously about 27–33%. To demonstrate the effect of nitrile rubber on the elasticity of the bonded permanent magnets of the present invention, FIG. 2 provides a graph of relative ultimate elongation as a function of acrylonitrile content for four commercially available nitrile rubbers having between about 16–45% acrylonitrile in a permanent magnet composition comprising 94.69 wt. % (73.82 vol. %) MQP®-S-9-8 Nd—Fe—B powder from Magnequench, 0.64 wt. % (3.86 vol. %) Ultrathene® UE 634-000 ethylene vinyl acetate, 2.55 wt. % (15.14 vol. %) nitrile rubber and 1.58 wt. % (4.55 vol. %) Hubersil® 1635 silica. The four commercially available nitrile rubbers include Nipol® 1043 having an acrylonitrile content of 29%, Nipol® N926 having an acrylonitrile content of about 16%, and Nipol® 1041 having an acrylonitrile content of about 41%, each available from ZEON Chemicals L. P. of Louisville, Ky., and Chemigum N-206 having an acrylonitrile content of about 45% (also described as an ultra-high nitrile polymer) provided by Goodyear Chemicals of Akron, Ohio. Advantageously, the permanent magnet composition comprises the nitrile rubber in an amount of about 8 vol. % up to about 68 vol. %, and more advantageously in an amount of about 13 to about 30 vol. %. Optimal physical properties for permanent magnets of the present invention may be achieved with a nitrile rubber having an acrylonitrile content of about 29% in an amount of about 15–16 vol. % of the composition.

The binder system of the present invention also comprises a precipitated amorphous silica that acts as a lubricant and reinforcing agent for the spherical magnet particles. With the irregular flake-shaped particles used in the prior magnet compositions, as the flakes fractured, the surface area was increased resulting in a weakening of the binder matrix due to the inability of the binder to coat the particles completely. With the spherical magnet particles in the composition of the present invention, the regular spherical surface provides less surface area than the irregular flakes thereby allowing for a higher possible particle loading, and the spheres act like tiny ball bearings which are easily incorporated into the resin matrix with little to no fracture tendency. More lubricant is provided between particles, and because the surface area is not increasing through fracture of particles, the lubricant continues to serve its function. With the silica present as the lubricant, the spherical particles have a tendency to roll instead of fracture, thereby preventing displacement of the binder and interaction between particles, which reduces or eliminates the risk of sparking and fire. The presence of the silica further benefits the heat aging properties and the ultimate elongation of the permanent magnet. It has been found that elimination of the silica component of the binder results in a drastic decrease in ultimate elongation. Thus, the composition of the present invention advantageously comprises about 1 to about 15 vol. % of silica, and advantageously about 3 to about 10 vol. %. Optimal physical properties for permanent magnets of the present invention may be achieved with a silica content of about 4–5 vol. %. Examples of commercially available precipitated amorphous silica which may be used in accordance with the composition of the present invention include Hubersil® 1635 from J. M. Huber Corporation, Atlanta, Ga., and Ultrasil® VN2 from Degussa A G Corporation of Germany.

In an exemplary embodiment of the present invention, the binder further includes a thermoplastic resin, such as ethylene vinyl acetate. Without ethylene vinyl acetate in the binder, a higher ultimate elongation is exhibited by the permanent magnet, so ethylene vinyl acetate may be added to the composition to regulate the stiffness and other physical properties of the magnet. Ethylene vinyl acetate may be present in an amount up to about 50% of the weight of the binder. Advantageously, the permanent magnet composition of the present invention comprises up to about 8 vol. % ethylene vinyl acetate, and advantageously about 2–5 vol. %. Optimal physical properties for permanent magnets of the present invention may be achieved with an ethylene vinyl acetate content of about 3–4 vol. %. Examples of commercially available ethylene vinyl acetate products include Ultrathene® UE 634-000 from Equistar Chemicals of Houston, Tex., and Levapren® HV 500 from Bayer A G of Germany.

In addition to the above described magnetic powder and binder components, the permanent magnet composition may further include additives such as sulphur, Altax® (R. T. Vanderbilt Company, Inc., Norwalk, Conn.), stearic acid, methyl Tuads® (R. T. Vanderbilt Company, Inc., Norwalk, Conn.), Agerite® (B. F. Goodrich Company, New York, N.Y.) or any other known additive for rubber compositions. Advantageously, the additives are present in an amount of about 20 wt. % or less of the total weight of the nitrile rubber.

The following is one method which may be used to produce permanent magnets having the composition of the present invention, but this method is not intended to restrict in any way the scope of the present invention. The binder may be introduced into a two-roll calendar mill to form a band around one of the rolls. The magnetic powder is then introduced at the nip in the rolls. Because the particles are small and uniform in size and shape, i.e., spherical, the particles act as little ball bearings and roll in the nip in the mill until they are captured and incorporated into the binder. Due to the spherical shape of the particles, there is little interference between the particles and no sparking occurs, and heat during the mixing process is kept to a minimum. The spherical nature of the particles also allows greater success in using the material of the present invention in a batch process using a Banbury intensive mixer, as there is no need for mixing in an inert atmosphere. The resultant mixture is worked into thin sheets, and these sheets are then placed together and "built up" to produce the desired thickness for the permanent magnet. This building up process does not result in significant reduction of the particle size of the magnet powder, and typically does not result in any reduction in particle size. The resultant sheet is flexible, but does not exhibit significant green strength. The sheets may then be die cut, pressed, or slit to achieve the desired shape. The sheets are then cured in a convection or conveyor type oven, for example, at about 135° C. for about 2 hours. During the curing process, the mechanical properties of the permanent magnet increase significantly.

The permanent magnets of the present invention exhibit high ultimate elongation, which is believed to have never been achieved in a flexible rare earth permanent magnet concurrently with good magnetic properties. In the past, the rubbery nature, or elasticity, of the magnets was sacrificed to obtain high loading of the magnet particles to achieve the desired magnetic properties. Percent ultimate elongation on the order of 10% is typical in rare earth bonded permanent magnets previously available having volumetric loadings between about 58 and about 80 vol. %. Magnets of the present invention at the same or similar volumetric loading exhibit elasticity on the order of about 100% elongation or greater, and advantageously about 200% elongation or greater.

EXAMPLES

Example 1

A permanent magnet (Test Sample 1) was fabricated using the above-described two-roll mill process with the composition of Table 1.

TABLE 1

| Material | weight | wt. % | specific gravity | cc/ 100 g | vol. % |
|---|---|---|---|---|---|
| MQP ®-S-9-8 | 225 | 94.69 | 7.4 | 30.405 | 73.82 |
| Nipol ® 1043 | 6.05 | 2.55 | 0.97 | 6.237 | 15.14 |
| Ultrathene ® UE634-000 | 1.512 | 0.64 | 0.95 | 1.592 | 3.86 |
| Hubersil ® 1635 Silica | 3.75 | 1.58 | 2.00 | 1.875 | 4.55 |
| Additives | 1.317 | 0.55 | varies | 1.079 | 2.62 |
| Total | 237.63 | 100 | — | 41.188 | 100 |

For comparative purposes, Comparative Sample 1 was manufactured in accordance with Example 2 of U.S. Pat. No. 4,873,504 using MQP®-A powder from Magnequench at a volume loading of about 68% in an Ultrathene® UE 634-000 binder. The magnetic properties before and after heat aging of Test Sample 1 and Comparative Sample 1 are provided in Table 2.

TABLE 2

| Sample | Vol. % | Br (Gauss) | Hc (Oersteds) | Hci (Oersteds) | Hours @ 100° C. | % Change |
|---|---|---|---|---|---|---|
| Comparative Sample 1 | ~68 | 5270 | | | 0 | 0 |
| | | | 4750 | | 0 | 0 |
| | | | | 15290 | 0 | 0 |
| | | 4950 | | | 3293 | −6.1 |
| | | | 3180 | | 3293 | −33.1 |
| | | | | 8850 | 3293 | −42.1 |
| Test Sample 1 | ~74 | 4750 | | | 0 | 0 |
| | | | 3700 | | 0 | 0 |
| | | | | 8600 | 0 | 0 |
| | | 4460 | | | 3264 | −6.1 |
| | | | 3570 | | 3264 | −3.5 |
| | | | | 8600 | 3264 | 0 |

Referring to Table 2, there is no change in loss of residual induction (Br) between Test Sample 1 and Comparative Sample 1. However, it is demonstrated that significant loss in the coercivity, specifically in the coercive force Hc and intrinsic coercivity Hci, is exhibited by the magnet produced in accordance with the prior art, whereas the Test Sample 1 made in accordance with the present invention exhibits only a small loss of magnetic properties over time at elevated temperature. Thus, magnets of the present invention exhibit a significant improvement in heat aging, thereby enabling the materials to be used in long term, elevated temperature environments.

Example 2

Test Sample 1, Comparative Sample 1 and a Comparative Sample 2 were subjected to various physical tests to determine tensile strength, ultimate elongation, shear strength, thermal conductivity and coefficient of linear thermal expansion. The results are provided in Tables 3–6. Comparative Sample 2 was made as described for Comparative Sample 1, but with a volume loading of about 80%. Tensile strength and elongation were determined in accordance with ASTM D412 with a crosshead speed of 20 in./min. for the Test Sample 1 and a crosshead speed of 2 in./min. for the comparative samples. Shear strength was determined in accordance with ASTM D732. Thermal conductivity was determined in accordance with ASTM C177. The coefficient of linear thermal expansion was determined in accordance with ASTM D696 for a temperature range of −30° C. to +30° C.

TABLE 3

| Sample | Dimension (In.) Width × Thickness | Tensile Strength (psi) | Elongation (%) |
|---|---|---|---|
| Test Sample 1 | | | |
| Specimen 1 | 0.250 × 0.097 | 140 | 260 |
| Specimen 2 | 0.250 × 0.103 | 144 | 250 |
| Specimen 3 | 0.250 × 0.100 | 152 | 250 |
| Specimen 4 | 0.250 × 0.100 | 156 | 250 |
| Specimen 5 | 0.250 × 0.097 | 148 | 250 |
| Average | | 148 | 250 |
| Comparative Sample 1 | | | |
| Specimen 1 | 0.250 × 0.125 | 470 | 10 |
| Specimen 2 | 0.250 × 0.125 | 450 | 10 |
| Specimen 3 | 0.250 × 0.125 | 430 | 10 |
| Specimen 4 | 0.250 × 0.124 | 450 | 10 |
| Specimen 5 | 0.250 × 0.126 | 420 | 10 |
| Average | | 440 | 10 |
| Comparative Sample 2 | | | |
| Specimen 1 | 0.250 × 0.122 | 460 | 10 |
| Specimen 2 | 0.250 × 0.121 | 470 | 10 |
| Specimen 3 | 0.250 × 0.122 | 470 | 10 |
| Specimen 4 | 0.250 × 0.122 | * | * |
| Specimen 5 | 0.250 × 0.122 | * | * |
| Average | | 470 | 10 |

*Damaged in Preparation

TABLE 4

| Sample | Thickness (In.) | Shear Strength (psi) |
|---|---|---|
| Test Sample 1 | | |
| Specimen 1 | 0.093 | 205 |
| Specimen 2 | 0.093 | 203 |
| Specimen 3 | 0.093 | 202 |
| Average | | 203 |
| Comparative Sample 1 | | |
| Specimen 1 | 0.122 | 850 |
| Specimen 2 | 0.121 | 740 |
| Specimen 3 | 0.120 | 770 |
| Average | | 790 |

TABLE 4-continued

| Sample | Thickness (In.) | Shear Strength (psi) |
|---|---|---|
| Comparative Sample 2 | | |
| Specimen 1 | 0.123 | 820 |
| Specimen 2 | 0.123 | 820 |
| Specimen 3 | 0.123 | 620 |
| Average | | 750 |

TABLE 5

| Sample | Test Sample 1 | Comparative Sample 1 | Comparative Sample 2 |
|---|---|---|---|
| Sample Thickness (in) | 0.099 | 0.126 | 0.124 |
| Hot Face Temperature, ° F. | 76.77 | 73.86 | 74.82 |
| Cold Face Temperature, ° F. | 72.26 | 74.26 | 73.86 |
| Average Test Temperature, ° F. | 74.52 | 75.06 | 74.34 |
| Thermal Conductivity, (k) Btu-in/hr-ft$^2$-° F. | 4.89 | 11.0 | 16.4 |

The magnets of the present invention do exhibit a decrease in tensile and shear strengths and thermal conductivity as compared to magnets of the prior art. However, the decrease in those physical properties can be tolerated in many applications, particularly those that do not require the magnet to act as a structural component. Conversely, a drastic and unexpected improvement is obtained in the ultimate elongation of the magnet. In the past, the rubbery nature, or elasticity, of the magnets was sacrificed to obtain high loading of the magnet particles to achieve the desired magnetic properties. Only 10% elongation was observed in the prior art magnets having a volumetric loading of about 68 and about 80% compared to an elongation of about 250% in the magnets of the present invention having a volumetric loading of about 74%. The present invention has thus been demonstrated to achieve a 25-fold improvement in the elasticity of rare earth bonded permanent magnets. It is believed that such high elasticity has never been achieved in a flexible rare earth permanent magnet concurrently with good magnetic properties.

Example 3

A permanent magnet (Test Sample 2) was fabricated using the above-described two-roll mill process with the composition of Table 6.

TABLE 6

| Material | weight | wt. % | specific gravity | cc/ 100 g | vol. % |
|---|---|---|---|---|---|
| MQP ®-S-9-8 | 180 | 93.44 | 7.4 | 24.324 | 69.29 |
| Nipol ® 1043 | 6.05 | 3.14 | 0.97 | 6.237 | 17.77 |
| Ultrathene ® UE634-000 | 1.512 | 0.78 | 0.95 | 1.592 | 4.53 |
| Hubersil ® 1635 Silica | 3.75 | 1.95 | 2.00 | 1.875 | 5.34 |
| Additives | 1.317 | 0.68 | varies | 1.079 | 3.07 |
| Total | 192.63 | 100 | — | 35.107 | 100 |

The physical properties were similar to Test Sample 1, in particular, the permanent magnet exhibited a drastic increase in ultimate elongation as compared to permanent magnets of the prior art.

Example 4

A Comparative Sample 3 was made using a common binder system with the MQP®-S-9-8 powder, namely a Hypalon® 45/Vistanex® binder mixture (a chlorosulfonated polyethylene available from DuPont Dow Elastomers of Wilmington, Del., and a polyisobutylene available from Exxon Chemical of Irving, Tex.). Comparative Sample 3 exhibited lower tensile strength and elongation compared to Test Sample 1, and when subjected to aging at 135° C., the magnet became hard and brittle after only 105 minutes.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of Applicant's general inventive concept.

What is claimed is:

1. A flexible permanent magnet composition comprising:

atomized, generally spherical rare earth magnet particles; and a binder comprising a nitrile rubber and a precipitated amorphous silica.

2. The composition of claim 1 wherein the binder further comprises an ethylene vinyl acetate copolymer.

3. The composition of claim 1 wherein the rare earth magnet particles are included in an amount of about 30–80 vol. %.

4. The composition of claim 1 wherein the rare earth magnet particles are included in an amount of about 58–74 vol. %.

5. The composition of claim 1 wherein the silica is included in an amount of about 1–15 vol. % and the nitrile rubber is included in an amount of about 8–68 vol. %.

6. The composition of claim 1 wherein the binder further comprises an ethylene vinyl acetate copolymer in an amount up to about 8 vol. % of the composition.

7. The composition of claim 1 comprising the binder in an amount in the range of about 26 vol. % to about 42 vol. %, and the rare earth magnet particles in an amount of about 58 vol. % to about 74 vol. %.

8. The composition of claim 1 wherein the rare earth magnet particles comprise a neodymium-iron-boron alloy.

9. The composition of claim 1 wherein the rare earth magnet particles have a size distribution including a median particle size in the range of about 35–55 $\mu$m with a standard deviation in the range of about 10–30 $\mu$m and less than about 0.1% of the particles having a diameter above about 115 $\mu$m.

10. The composition of claim 9 wherein the median particle size is in the range of about 40–45 $\mu$m.

11. The composition of claim 10 wherein at least about 90% of the particles have a diameter below about 70 $\mu$m, and less than about 10% of the particles have a diameter below about 20 $\mu$m.

12. The composition of claim 1 wherein the rare earth magnet particles comprise an alloy selected from the group consisting of neodymium-iron-boron, praseodymium-iron-boron, samarium-cobalt, samarium-iron-cobalt, samarium-iron-nitride and dysprosium-cobalt.

13. The composition of claim 1 wherein the nitrile rubber is a copolymer of butadiene and acrylonitrile with about 16–51% acrylonitrile.

14. The composition of claim 13 wherein the nitrile rubber comprises about 23–37% acrylonitrile.

15. The composition of claim 13 wherein the nitrile rubber comprises about 27–33% acrylonitrile.

16. A flexible permanent magnet composition comprising:

a binder comprising a nitrile rubber, a thermoplastic resin, and a precipitated amorphous silica; and atomized, generally spherical rare earth magnet particles in the binder at a volumetric loading of about 58–74 vol. %.

17. The composition of claim 16 wherein the thermoplastic resin is an ethylene vinyl acetate copolymer included in an amount of about 2 to about 5 vol. % of the composition.

18. The composition of claim 16 wherein the silica is included in an amount of about 3–10 vol. % of the composition.

19. The composition of claim 16 wherein the nitrile rubber is included in an amount of about 13–30 vol. % of the composition.

20. The composition of claim 16 wherein the rare earth magnet particles comprise a neodymium-iron-boron alloy.

21. The composition of claim 16 wherein the rare earth magnet particles have a size distribution including a median particle size in the range of about 35–55 $\mu$m with a standard deviation in the range of about 10–30 $\mu$m and less than about 0.1% of the particles having a diameter above about 115 $\mu$m.

22. The composition of claim 21 wherein the median particle size is in the range of about 40–45 $\mu$m.

23. The composition of claim 22 wherein at least about 90% of the particles have a diameter below about 70 $\mu$m, and less than about 10% of the particles have a diameter below about 20 $\mu$m.

24. The composition of claim 16 wherein the rare earth magnet particles comprise an alloy selected from the group consisting of: neodymium-iron-boron, praseodymium-iron-boron, samarium-cobalt, samarium-iron-cobalt, samarium-iron-nitride and dysprosium-cobalt.

25. The composition of claim 16 wherein the nitrile rubber is a copolymer of butadiene and acrylonitrile with about 16–51% acrylonitrile.

26. The composition of claim 25 wherein the nitrile rubber comprises about 23–37% acrylonitrile.

27. The composition of claim 25 wherein the nitrile rubber comprises about 27–33% acrylonitrile.

28. A flexible permanent magnet composition comprising:

a nitrile rubber comprising about 23–37% acrylonitrile;

an ethylene vinyl acetate copolymer;

a precipitated amorphous silica; and a plurality of atomized, generally spherical magnet particles of a Ne—Fe—B alloy having a size distribution including a median particle size in the range of about 35–55 $\mu$m with a standard deviation in the range of about 10–30 $\mu$m and less than about 0.1% of the particles having a diameter above about 115 $\mu$m.

29. The composition of claim 28 wherein the ethylene vinyl acetate copolymer is included in an amount of about 2 to about 5 vol. % of the composition.

30. The composition of claim 28 wherein the silica is included in an amount of about 3–10 vol. % of the composition.

31. The composition of claim 28 wherein the nitrile rubber is included in an amount of about 13–30 vol. % of the composition.

32. The composition of claim 28 wherein the median particle size is in the range of about 40–45 $\mu$m.

33. The composition of claim 28 wherein at least about 90% of the particles have a diameter below about 70 $\mu$m, and less than about 10% of the particles have a diameter below about 20 $\mu$m.

34. The composition of claim 28 wherein the nitrile rubber comprises about 27–33% acrylonitrile.

35. The composition of claim 28 wherein the rare earth magnet particles are included in an amount of about 30–80 vol. %.

36. The composition of claim 28 wherein the rare earth magnet particles are included in an amount of about 58–74 vol. %.

37. A permanent magnet comprising:

a nitrile rubber comprising about 23–37% acrylonitrile;

an ethylene vinyl acetate copolymer;

a precipitated amorphous silica; and atomized, generally spherical magnet particles of a Ne—Fe—B alloy having a size distribution including a median particle size in the range of about 35–55 $\mu$m with a standard deviation in the range of about 10–30 $\mu$m and less than about 0.1% of the particles having a diameter above about 115 $\mu$m, wherein the magnet has a percent ultimate elongation greater than about 100%.

38. The composition of claim 37 wherein the ethylene vinyl acetate copolymer is included in an amount of about 2 to about 5 vol. % of the composition.

39. The composition of claim 37 wherein the silica is included in an amount of about 3–10 vol. % of the composition.

40. The composition of claim 37 wherein the nitrile rubber is included in an amount of about 13–30 vol. % of the composition.

41. The composition of claim 37 wherein the median particle size is in the range of about 40–45 $\mu$m.

42. The composition of claim 37 wherein at least about 90% of the particles have a diameter below about 70 $\mu$m, and less than about 10% of the particles have a diameter below about 20 $\mu$m.

43. The composition of claim 37 wherein the nitrile rubber comprises about 27–33% acrylonitrile.

44. The composition of claim 37 wherein the magnet has a percent ultimate elongation greater than about 200%.

45. The composition of claim 37 wherein the rare earth magnet particles are included in an amount of about 30–80 vol. %.

46. The composition of claim 37 wherein the rare earth magnet particles are included in an amount of about 58–74 vol. %.

47. A permanent magnet comprising:

about 13–30 vol. % nitrile rubber comprising about 23–37% acrylonitrile;

about 2–5 vol. % ethylene vinyl acetate copolymer;

about 3–10 vol. % precipitated amorphous silica; and about 58–74 vol. % atomized, generally spherical magnet particles of a Ne—Fe—B alloy having a size distribution including a median particle size in the range of about 35–55 $\mu$m with a standard deviation in the range of about 10–30 $\mu$m and less than about 0.1% of the particles having a diameter above about 115 $\mu$m, wherein the magnet has a percent ultimate elongation greater than about 100%.

48. The composition of claim 47 wherein the median particle size is in the range of about 40–45 $\mu$m.

49. The composition of claim 47 wherein at least about 90% of the particles have a diameter below about 70 $\mu$m, and less than about 10% of the particles have a diameter below about 20 $\mu$m.

50. The composition of claim 47 wherein the nitrile rubber comprises about 27–33% acrylonitrile.

51. The composition of claim 47 wherein the magnet has a percent ultimate elongation greater than about 200%.

* * * * *